US005518237A

United States Patent [19]

Bellehumeur

[11] Patent Number: 5,518,237

[45] Date of Patent: May 21, 1996

[54] HOLLOW, FILLED, RING-SHAPED HOCKEY PUCK

[76] Inventor: Alex R. Bellehumeur, 6242 Napoli Ct., Long Beach, Calif. 90803

[21] Appl. No.: 380,241

[22] Filed: Jan. 30, 1995

Related U.S. Application Data

[63] Continuation-in-part of Ser. No. 233,412, Apr. 28, 1994, abandoned.

[51] Int. Cl.[6] ..... A63B 21/00

[52] U.S. Cl. ..... 273/128 R

[58] Field of Search ..... 273/108, 126 R, 273/126 A, 128 R, 128 A, 128 CS, 57.2

[56] References Cited

U.S. PATENT DOCUMENTS

| | | | |
|---|---|---|---|
| 2,812,184 | 11/1957 | McGee | 273/128 R |
| 3,675,928 | 7/1972 | Gentile | 273/128 R |
| 3,887,188 | 6/1975 | Beauchamp et al. | 273/128 R |
| 4,078,801 | 3/1978 | White, Sr. | 273/128 R |
| 4,153,253 | 5/1979 | White, Sr. | 273/128 R |
| 5,275,410 | 1/1994 | Bellehumeur et al. | 273/128 R |
| 5,284,343 | 2/1994 | Bigornia et al. | 273/128 R |

*Primary Examiner*—Raleigh W. Chiu

*Attorney, Agent, or Firm*—Edgar W. Averill, Jr.

[57] ABSTRACT

A hockey puck made from a polymer in the shape of a hollow ring surrounding a central web. The inner volume of the hollow ring is partially filled with a filler material or a combination of materials which may be a liquid or a granule. The puck is capable of riding over a rough surface in a very stable manner with a minimized tendency to turn over or to turn on its side.

16 Claims, 2 Drawing Sheets

HOLLOW, FILLED, RING-SHAPED HOCKEY PUCK

CROSS REFERENCE TO RELATED APPLICATIONS

This application is a continuation in part of applicant's pending U.S. patent application Ser. No. 08/233,412 filed Apr. 28, 1994, and entitled "Puck for Use on Non-Ice Surface" now abandoned.

BACKGROUND OF THE INVENTION

The field of the invention is sporting goods and the invention relates more particularly to roller hockey and to pucks used for roller hockey.

Numerous designs of pucks have been used for use on surfaces other than ice. For the professional or upper level of roller hockey, the game is played on a relatively smooth cement surface. The game, however, is also commonly played on asphalt streets and other rough surfaces. The typical solid or completely filled puck has a significant tendency to bounce along a rough surface and will often flip over or onto its side.

One style of roller hockey puck is a completely hollow blow-molded puck completely filled with granulated sugar or other material and having a central vertical rivet or bolt to prevent the puck from bowing outwardly or twisting out of shape.

A professional level of puck which is also commonly used for street hockey is shown in applicant's U.S. Pat. No. 5,275,410.

A puck having a central weight and an outer ring of foam is shown in White, Sr. U.S. Pat. No. 4,078,801. A Puck containing an impact measuring device is shown in the Shepherd U.S. Pat. No. 5,207,720. A puck having built-in projections is shown in the Keating, et al. U.S. Pat. No. 5,184,820. A felt puck including a ballast weight is shown in the Beauchamp, et al. U.S. Pat. No. 3,887,188. Another puck having built-in bosses and an opening 8 the center is shown in the Hsieh U.S. Pat. No. 5,288,072. A game puck having an air-cushioned hollow annular bumper is shown in Canadian Patent No. 2,070,003. A puck with a central depression and balls on the surface is shown in the Felber U.S. Pat. No. 3,784,204. A partially filled hollow puck is shown in the Bigornia, et al. U.S. Pat. No. 5,284,343. A sliding game piece having an annular hollow rubber bumper is shown in the McGee U.S. Pat. No. 2,812,184 which is not a puck.

None of these patents show a puck which can be used in roller hockey games on a rough surface which has a lesser tendency to turn over during play.

SUMMARY OF THE INVENTION

It is an object of the present invention to provide a puck for use on a non-ice surface which is unusually steady and is capable of riding over the rough surface with a decreased tendency to flip over as compared to the conventional hockey puck.

DESCRIPTION OF THE PREFERRED EMBODIMENTS

Figure 1:
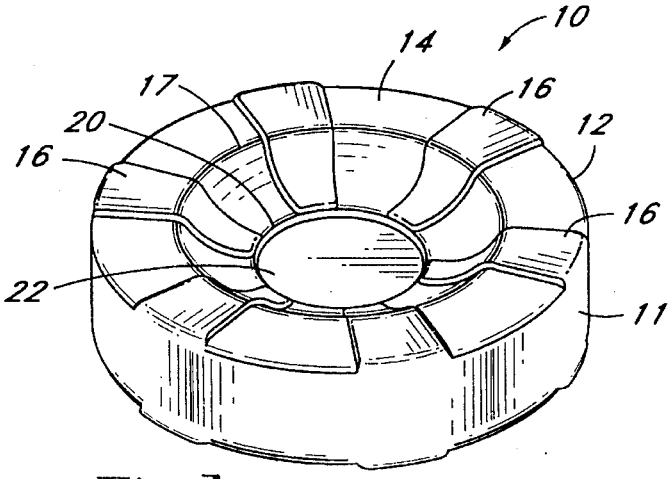
FIG. 1 is a prospective view showing the front and top of the hockey puck of the present invention.

The puck of the present invention is shown perspective view in FIG. 1 and indicated generally by reference character 10. Puck 10 has an outer peripheral ring-shaped wall 11. This wall is shown in cross-sectional view in FIG. 2 and can be seen to be a thin wall 11 having an upper edge 12 and a lower edge 13. Upper and lower disk-shaped or flat ring-shaped surface members 14 and 15 form the top and bottom of the puck and a plurality of runners 16 are formed along the top and bottom of the puck and are integrally formed from raised portions of the upper and lower flat ring-shaped surface members.

Figure 8:
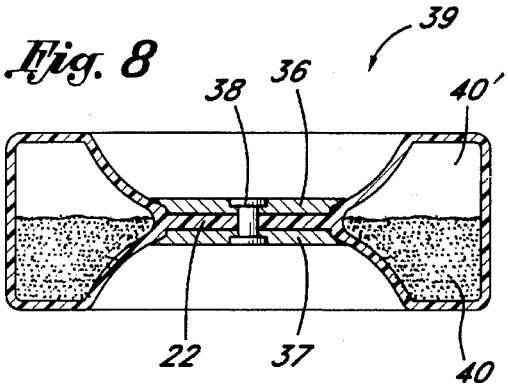
FIG. 8 is a cross-sectional view of an alternate embodiment of the puck of FIG. 1.

These ring-shaped surface members have an inner edge. The inner edge of the upper ring-shaped surface member is indicated by reference character 17 and that on the lower surface is indicated by reference character 17'. Inner, upper and lower wall members are indicated by reference characters 18 and 19 and these terminate at lower and upper edges 20 and 21 respectively. A solid disk or central web 22 is integral with and contacts lower and upper edges 20 and 21. Puck 10 is preferably formed by the process of blow-molding and has an enclosed inner volume 23 which is filled with a heavier than air filler 24. If filler 24 is silica sand, the preferred size of the puck weighs about 4½ oz. which is a desired weight for most roller hockey pucks. This weight can be increased by using a denser filler than silica sand 24, such as steel shot 25 shown in FIG. 5. It is also possible to increase the weight as indicated in FIG. 8 which is discussed below. It is likewise possible to decrease the weight of the puck to, for instance 3½ oz., by using a less dense filler or a lesser amount of filler.

Preferably, the puck of the present invention is blow-molded from a polymer such as high density polyethylene which may be modified with various polymers to make it softer, such as by the addition of ethylvinyl acetate. Such a material provides a small amount of deflection when the puck hits a wall or other hard surface giving it a desired bounce reminiscent of an ice hockey puck hitting a wall. When the puck is only partially filled, it has a tendency to be somewhat less bouncy off the boards as compared to a completely full puck. It is thus possible to fashion a puck with a desired amount of bounce off the boards. As a partially filled puck strikes the boards, the filler will continue to move for a fraction of a second, thereby eliminating too lively a bounce.

Figure 2:
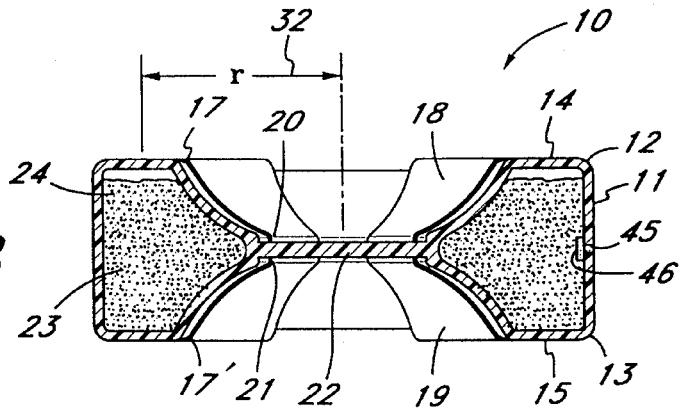
FIG. 2 is a cross-sectional view taken along line 2—2 of FIG. 3.
Figure 3:
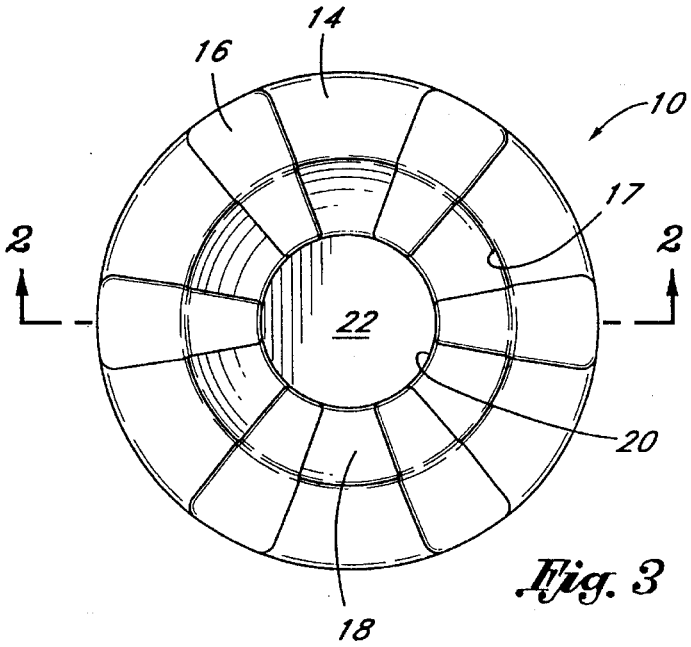
FIG. 3 is a plan view of the puck of FIG. 1.
Figure 4:
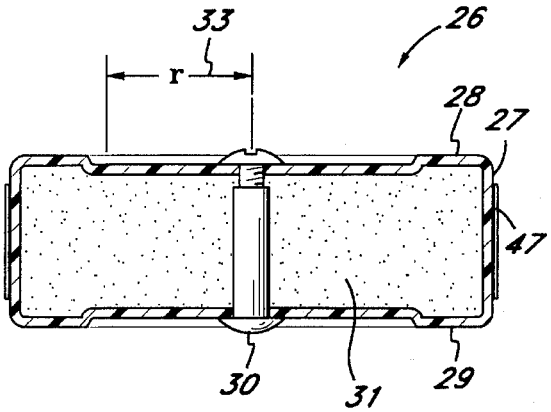
Fig. 4 (PRIOR ART)
FIG. 4 is a cross-sectional view of a prior art hockey puck.

An essential feature of the present invention is the weight distribution of the puck wherein a large amount of the weight is concentrated at a greater distance from the center of the puck than a conventional puck or than the prior art puck shown in FIG. 4. This puck is indicated generally by reference character 26 and has a hollow polymeric body 27, upper and lower rings 28 and 29 respectively, and a center screw and socket assembly 30. Puck 26 is filled with granulated sugar indicated by reference character 31. The weight distribution or moment of inertia of puck 26 versus puck 10 is vastly different. The moment of inertia is the product of two times the mass times the radius squared ($2 \times Mass \times Radius^2$). The radius is the center of the mass and, as can be seen in the drawings, the radius indicated by reference character 32 in FIG. 2 is substantially longer than radius 33 shown in FIG. 4. Because the moment of inertia of the present puck is much higher, the puck will remain spinning much longer and will also be more stable against flipping over because of its gyroscopic inertia. Still further, the weight distribution when the puck is partly filled is far more stable. Thus, with applicant's design it is possible to partly fill a puck such as puck 34 in FIG. 5 where metal shot 25 only partially fills the interior volume 35. In contrast, if 13 puck 26 were only partly filled with a granulated or liquid filler, it would be far more out of balance during play than if the weight were distributed in the annular hollow space of applicant's puck 10. In addition, puck 26 of FIG. 4 requires center screw and socket assembly 30 so that it will not bow outwardly or twist during use. The existence of this screw and socket assembly weakens the structure since it requires a pair of holes which in themselves weaken the top and bottom of the puck. Also, it requires a separate assembly step and could conceivable unscrew during play. Applicant's design completely eliminates the necessity for a screw and socket with no possibility of flying parts.

The ability to partially fill the interior of the puck while still not causing it to be grossly out of balance is a very important feature of applicant's invention. It has been observed in tests that applicant's puck is far more stable during play on a rough surface than conventional solid pucks. While not wishing to be bound by any theory, it is applicant's belief that the partial filling provides a stability against flipping over on a rough surface such as an asphalt surface. A partially filled puck actually has a shock absorbing ability since the filler can move somewhat independently of the outer shell which counteracts the sudden jolts from a rough surface. Thus, as the puck hits a bump, the filler can lift slightly and the outer shell remains stable against the surface. A partially filled puck also has a lower center of gravity since the weight is nearer the bottom of the puck and by virtue of that fact is less likely to flip over. It is also believed that the weight distribution removed from the center of the puck further decreases the tendency to flip over during play.

Figure 5:
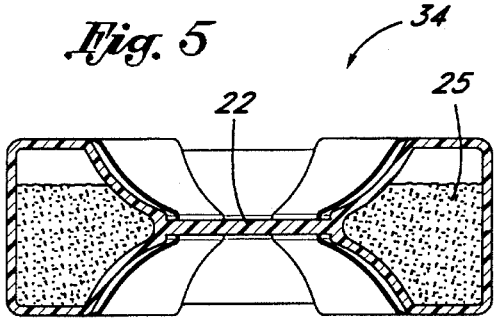
FIG. 5 is a cross-sectional view of an alternate embodiment of the puck of FIG. 1.

Applicant's design permits pucks of varying weights to be produced for different purposes. Thus, a puck can be partly filled with sand to provide a light puck, or essentially completely filled as shown in FIG. 2 to provide a puck of greater weight. If still further weight is required, a heavier filling such as iron filings or metal shot can be used as indicated in FIG. 5. It is also possible that the weight can be increased by riveting a pair of weights 36 and 37 to solid disk 22 by rivet 38 as shown in FIG. 8. Thus, puck 39 of FIG. 8 is partially filled with sand 40 leaving an air space 40', and yet can have any desired weight, depending on the size of the metal weights added.

Figure 6:
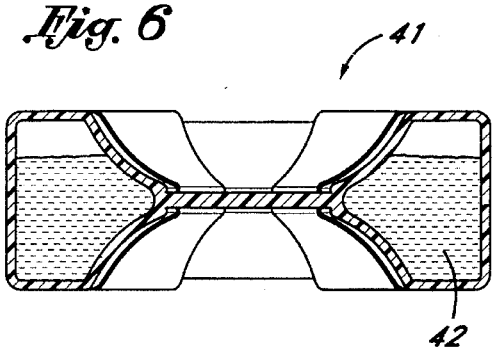
FIG. 6 is a cross-sectional view of an alternate embodiment of the puck of FIG. 1.

Puck 41 of FIG. 6 is filled with a liquid 42, such as water. It is also contemplated that a more viscus liquid, for instance of the viscosity of honey, could be used to provide a 9 more stable movement than water 42.

Figure 7:
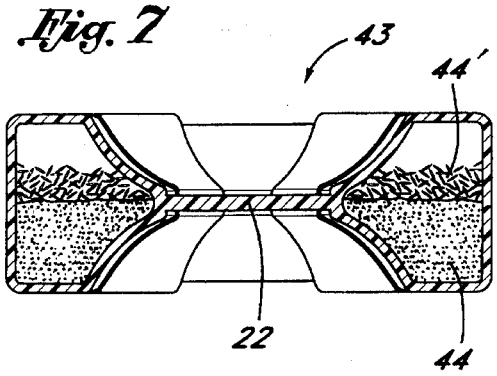
FIG. 7 is a cross-sectional view of an alternate embodiment of the puck of FIG. 1.

A still further variation is shown in puck 43 of FIG. 7 which is filled with a mixture of sand 44 and rice 44'. The rice will tend to quickly work its way to the top and the sand to the bottom as the puck passes over a rough surface and cause the puck to be heavier on the lower half than the upper half, thus causing it to be more stable. Other fillers contemplated include a mixture of water and sand, a viscus liquid such as honey, a mixture of sand and honey, a mixture of rice and metal shot or beads, a mixture of honey and metal beads and a mixture of styrofoam beads and sand. It thus can be seen that the present design provides a very wide array of fillers because of the relatively even weight distribution around the outer periphery of the puck. The center area vastly increases the strength of the puck and prevents any sort of twisting, but also provides a place for labeling the puck. Furthermore, its appearance is exceptionally attractive.

Figure 9:
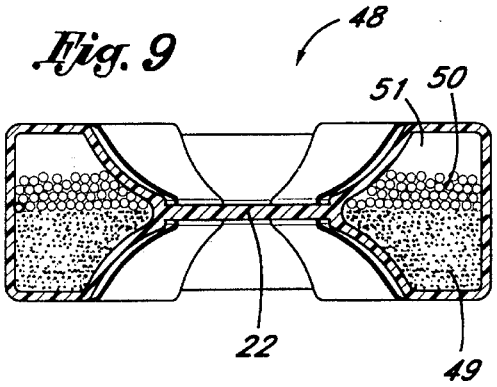
FIG. 9 is a cross-sectional view of an alternate embodiment of the puck of FIG. 1.

A puck which exhibits a very high degree of weight shifting with the heavier substance moving to the bottom is shown in FIG. 9 and indicated by reference character 48. Puck 48 is filled with a mixture of silica sand 49 and styrofoam beads 50. As the puck 48 slides on a rough surface, the sand quickly settles through the styrofoam beads (which could be of a diameter of ⅛". The result is a distribution such as that shown in FIG. 9 where almost all of the styrofoam beads are at the top providing a very low center of gravity and a very stable puck. If the puck should flip over in play, the sand will quickly work its way down again and the beads work their way up. Note that it is beneficial that the puck have an air space 51 above the beads. This permits greater movement of the solids within the puck and assists in the settling action. The open or air space should be at least 10% and preferably at least 20% so that the filler will be able to move within the volume and the heavier material to fall to the bottom. The difference in densities of the two materials should be substantial. By the term "substantial" it is intended to mean a difference of at least 100% in bulk density. The two different materials should each be present in a significant volume. That is, the volume should be at least 20% of one material so that it has a meaningful effect on weight distribution. There could, of course, be three or more materials of different densities. A contemplated filler would consist of 40%–45% by volume of silica sand, 40%–45% by volume of ⅛ diameter styrofoam beads and the balance of open air.

Applicant's design, thus, presents a puck which may be partially filled and yet still remain quite balanced during play. It may be economically fabricated by blow-molding and filled through the blow-hole 45 shown in FIG. 2, stoppered by a sonic welded plug 46. This blow-hole may alternatively be located on the face of the puck if desired by altering the mold design. By sonic welding a plug in the opening 45 it is not necessary to add a layer of tape such as tape 47 shown on the prior art puck 26 in FIG. 4 which tape is required to seal blow-molding blow hole 52.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A hockey puck for use on non-ice and less than smooth surfaces, said puck having a hollow body with an enclosed inner volume, said puck comprising:

a body comprising:

an outer peripheral ring shaped wall having an upper edge and a lower edge;

an upper disk-shaped surface member, said upper disk-shaped surface member extending inwardly from the upper edge of the ring shaped wall and said upper disk-shaped surface member having an inner edge;

a lower disk-shaped surface member, said lower disk-shaped surface member extending inwardly from the lower edge of the ring shaped wall and said lower disk-shaped surface member having an inner edge;

an inner, upper wall member extending downwardly from the inner edge of said upper disk-shaped surface member to a lower edge;

an inner, lower wall member extending downwardly from the inner edge of said lower disk-shaped surface member to an upper edge which upper edge contacts the lower edge of said inner, upper wall member to form a closed internal volume; and a heavier than air filler within said closed internal volume.

2. The hockey puck of claim 1 further including a solid disk held in the center of said puck body by the lower edge of said inner upper wall member and the upper edge of said inner lower wall member.

3. The hockey puck of claim 1 wherein said upper and lower flat ring-shaped member has a plurality of raised runner surfaces extending outwardly therefrom.

4. The hockey puck of claim 3 wherein said upper and lower flat ring-shaped members each have six raised runners.

5. The hockey puck of claim 2 wherein said inner upper wall member and said inner lower wall members slope to meet said solid disk.

6. The hockey puck of claim 1 wherein said filler is a granular filler.

7. The hockey puck of claim 6 wherein said filler is silica sand.

8. A hockey puck fabricated from a polymer in the shape of a hollow ring surrounding a central web, said hollow ring having an inner volume partially filled with a heavier than air filler.

9. The hockey puck of claim 8 wherein said filler fills no more than about ninety per cent of said inner volume.

10. The hockey puck of claim 9 wherein said puck further includes a weight held to said central web.

11. The hockey puck of claim 9 wherein said filler is a mixture of materials of at least two different densities.

12. The hockey puck of claim 8 wherein said filler is a liquid.

13. The hockey puck of claim 12 wherein said filler is water.

14. The hockey puck of claim 8 wherein said filler is metal shot.

15. A hockey puck having an inner volume filled with a mixture of at least two materials of substantially different densities and the inner volume being filled no more than about 80%.

16. The puck of claim 15 wherein the materials are silica sand and styrofoam beads.

* * * * *